US005186384A

United States Patent [19]

Nelson

[11] Patent Number: 5,186,384

[45] Date of Patent: Feb. 16, 1993

[54] COLLAPSIBLE RECEPTACLE FOR DISPOSAL OF ANIMAL WASTES

[75] Inventor: Robert J. Nelson, Atlantic Beach, Fla.

[73] Assignee: Dirty Business Deals, Inc., Bridgehampton, N.Y.

[21] Appl. No.: 827,147

[22] Filed: Jan. 28, 1992

[51] Int. Cl.[5] ..... B65D 5/16

[52] U.S. Cl. ..... 229/122; 229/117.14; 229/229; 294/1.3

[58] Field of Search ..... 294/1.3; 229/117.13, 229/117.14, 122, 229, 232

[56] References Cited

U.S. PATENT DOCUMENTS

| | | | |
|---|---|---|---|
| 268,636 | 12/1982 | De Meza . | |
| 1,106,282 | 8/1914 | Coats . | |
| 1,364,556 | 1/1921 | Hurff . | |
| 2,078,038 | 4/1937 | Stephens . | |
| 2,293,342 | 8/1942 | Inman | 229/117.14 |
| 2,337,199 | 12/1943 | Holy . | |
| 2,385,898 | 10/1945 | Waters . | |
| 2,453,973 | 11/1948 | Coats . | |
| 2,740,576 | 4/1956 | Franck . | |
| 2,787,408 | 4/1957 | André . | |
| 3,202,340 | 8/1965 | Johnston | 229/117.14 |
| 3,345,670 | 10/1967 | Charie . | |
| 3,534,424 | 10/1970 | Levinson . | |
| 3,630,430 | 12/1971 | Struble . | |
| 3,639,937 | 2/1972 | Sweeney . | |
| 3,765,044 | 10/1973 | Hanahan et al. | 294/1.3 |
| 3,767,247 | 10/1973 | Wetzler . | |
| 3,885,266 | 5/1975 | Nafziger | 294/1.3 |
| 3,971,503 | 7/1976 | Allan . | |
| 4,103,952 | 8/1978 | Thompson | 294/1.3 |
| 4,186,955 | 2/1980 | Campbell . | |
| 4,201,292 | 5/1980 | Davidson et al. | 229/232 |
| 4,222,598 | 9/1980 | Ullger . | |
| 4,252,356 | 2/1981 | Tokuzumi | 294/1.3 |
| 4,272,116 | 6/1981 | Tufte, Jr. | 294/1.3 |
| 4,458,932 | 7/1984 | Resch . | |
| 4,518,115 | 5/1985 | Sedwick | 229/117.14 |
| 4,746,019 | 5/1988 | Prater | 229/232 |
| 4,860,886 | 8/1989 | Northrup et al. | 229/229 |
| 4,865,371 | 9/1989 | Egberg | 294/1.3 |
| 4,974,893 | 12/1990 | Grahn | 294/1.3 |

FOREIGN PATENT DOCUMENTS

| | | | |
|---|---|---|---|
| 0406059 | 1/1991 | European Pat. Off. | 294/1.3 |
| 2199476 | 7/1988 | United Kingdom | 294/1.3 |

*Primary Examiner*—Allan N. Shoap
*Assistant Examiner*—Christopher J. McDonald
*Attorney, Agent, or Firm*—Gottlieb, Rackman & Reisman

[57] ABSTRACT

A receptacle for the disposal of animal wastes is provided. The receptacle includes a collapsible container having a selectively sealable opening for enabling access to the interior of the container and an integrated handle for carrying the container. The handle has a detachable scoop stick for gathering up animal waste and placing the wastes in the container through the opening. Once wastes are in the container, a closure panel is positioned over the opening so that the animal waste is maintained in the receptacle.

12 Claims, 2 Drawing Sheets

COLLAPSIBLE RECEPTACLE FOR DISPOSAL OF ANIMAL WASTES

BACKGROUND OF THE INVENTION

This invention is directed to a receptacle for the disposal of animal waste, and more particularly to a sanitary collapsible receptacle for disposing of animal wastes which includes an integrated scoop stick for directing excrement into the receptacle and an integrated carrying handle having an interlocking closure panel for ensuring the sanitary disposal of the excrement.

The removal and disposal of animal wastes on streets and sidewalks has been a public and environmental problem for many years. Although this problem mainly exists in cities or other crowded areas, it is becoming an increasing concern in suburban and even rural areas.

Many cities and towns now require pet owners to remove any waste produced by their pets or face the risk of receiving a fine or ticket. As a result, various devices have been designed for the pet owner for cleaning up the waste.

One of the recurring problems with various devices for disposing of animal wastes is that these devices, if frequently used, become soiled and present a sanitary problem wherever they are stored. Therefore, it would be desirable to provide a device or product which is inexpensive to purchase, and which may be disposed of after use.

SUMMARY OF THE INVENTION

Generally speaking, in accordance with the invention, a receptacle for the disposal of animal wastes is provided. The receptacle includes a collapsible container having a selectively sealable opening for enabling access to the interior of the container and an integrated handle for carrying the container. The handle has a detachable scoop stick for gathering up animal waste and placing the waste in the container through the opening. Once the waste is in the container, a closure panel is positioned over the container's opening so that the animal waste is maintained in the receptacle.

The animal waste disposal receptacle of the invention is made from a cardboard blank which is appropriately folded and manipulated in order to construct the receptacle. The blank includes a series of panels foldably connected to each other along common fold lines. The panels define the walls of the receptacle container When the blank is assembled. One end panel is connected to a handle panel which is formed with a detachable portion suitable for use as a scoop stick. The remaining portion of the handle panel may be used as a handle for carrying the receptacle during use.

The other end panel of the receptacle includes a partially detachable door or closure element which enables selective access to the inside of the receptacle container. In use, the container closure element is opened so that waste or excrement may be placed inside the container. The container is then sealed by closing the closure element in order to maintain sanitary conditions. Since the receptacle of the invention is made of cardboard, the receptacle is simply disposed of after use.

The receptacle of the invention is normally sold in a collapsed folded condition. The user first applies hand pressure on opposing ends of the collapsed receptacle in order to open the receptacle to its operating condition. In this configuration, the end panels thereof lock into place, forming a box shaped configuration. Then, the scoop stick is punched out from the handle panel. Thereafter, the closure element formed in one of the end panels is pulled out and folded down under the container so that it does not interfere with the operation thereof. Using the scoop stick, the user places the animal waste or excrement into the container. After finishing with the scoop stick, the scoop stick is then inserted into the container. Then, the closure element is placed over the opening into the container and locked into place. The receptacle is then carried to the nearest receptacle for disposal.

Accordingly, it is an object of the invention to provide a receptacle for the disposal of animal wastes.

It is another object of the invention to provide an animal waste receptacle having an integrated carrying handle, scoop stick and closure element.

Yet a further object of the invention is to provide an animal waste receptacle which may be sold in a collapsed condition, but which is operable in an expanded condition.

Still another object of the invention is to provide an animal waste receptacle which ensures the sanitary disposal of animal excrement.

A further object of the invention is to provide a cardboard blank for constructing an animal waste receptacle.

Yet another object of the invention is to provide an animal waste disposal receptacle which is both easy to use and disposable.

Still other objects and advantages of the invention will in part be obvious and Will in part be apparent from the following description.

The invention accordingly comprises the several steps and the relation of one or more such steps with respect to each of the others, and the article of manufacture possessing the features, properties and relation of elements which will be exemplified in the article hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENT

Figure 1:
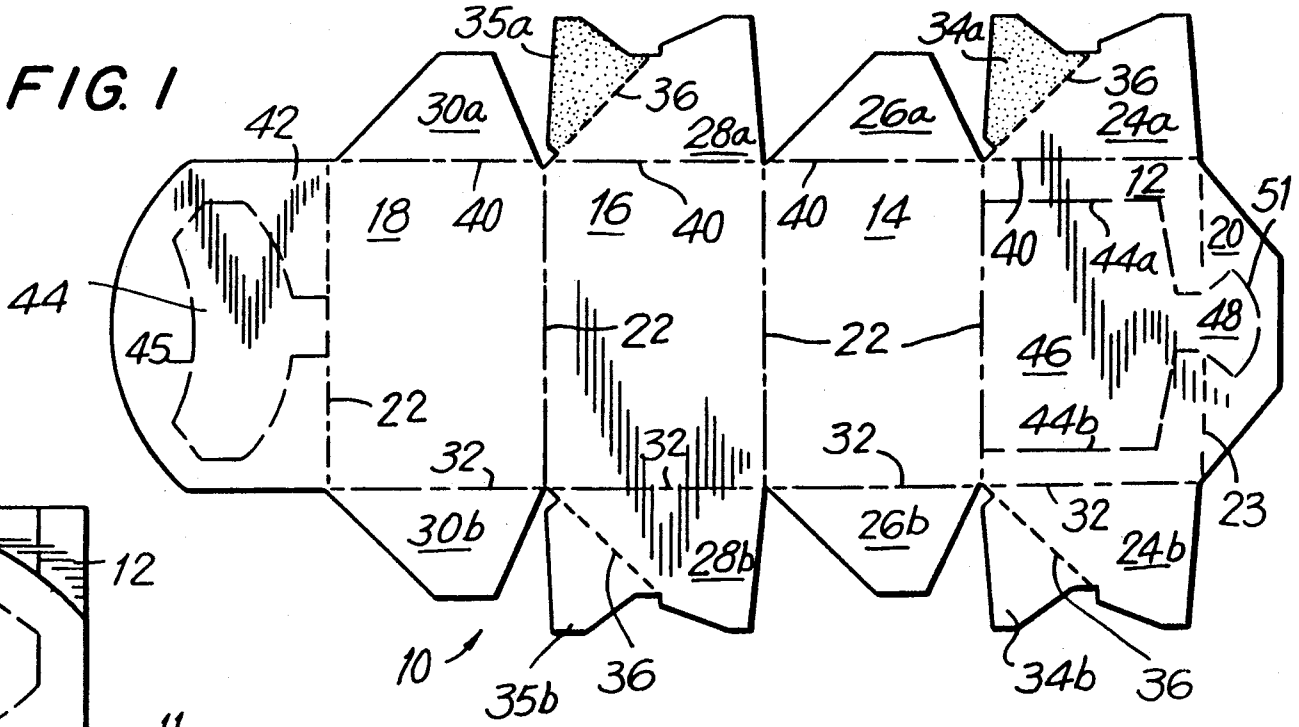
FIG. 1 is a top plan view of a blank from which an animal waste disposal receptacle in accordance with the invention may be constructed.

Referring first to FIG. 1, a cardboard unit blank 10 from which the animal waste disposal receptacle of the invention is constructed is shown. Cardboard blank 10 is made from a foldable flexible paper board material preferably having a high acid content for rapid biodegradability. Blank 10 includes a series of panels 12, 14, 16 and 18 foldably connected to each other along fold lines 22.

Panel 12 has a flap attached thereto along fold line 23. In addition, panels 12, 14, 16 and 18 each include a first side flap 24*a*, 26*a*, 28*a* and 30*a*, respectively, and a second side flap 24*b*, 26*b*, 28*b* and 30*b*, respectively. Flaps 24*a* and 24*b* include sections 34*a* and 34*b*, while flaps 28*a* and 28*b* also include sections 35*a* and 35*b*. All of these flaps and sections are used for constructing the waste disposal receptacle of the invention from cardboard blank 10, as described below.

Panel 18 is foldably connected or attached to a handle panel 42, as shown in FIG. 1. Handle panel 42 includes a scoop stick cut-out 44 defined by perforated line 45.

Figure 2:
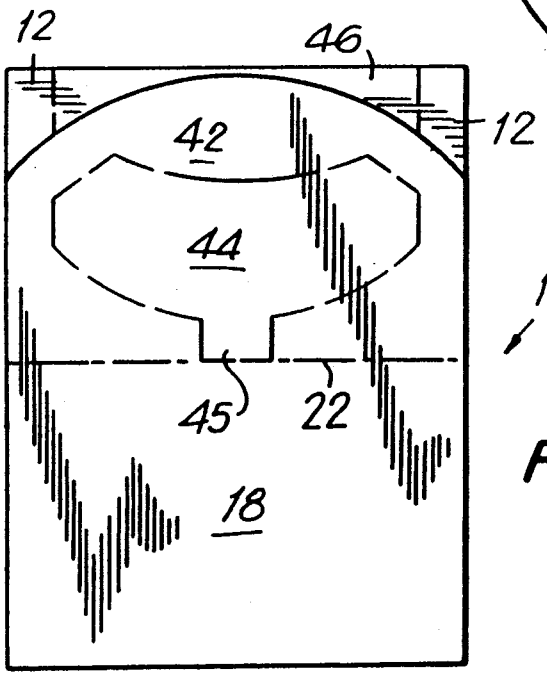
FIG. 2 is a side elevational view of the animal waste disposal receptacle of the invention in a collapsed or packaged condition.

Panel 12 also includes an end flap 20 and both are formed with a closure element cut-out 46, as best shown in FIGS. 1 and 2. Cut-out 46 is defined by perforated lines or edges 49*a*, 49*b* and 51, and is formed with a locking tab 48. Closure element cut-out 46 is pivotally swingable along fold line 22 for selectively opening and closing the opening formed by cut-out 46.

In order to construct the waste disposal receptacle of the invention from blank 10, sections 34*a* and 34*b* of closure flap 24*a* and 24*b* are placed below and attached to the undersides of closure flaps 26*a* and 26*b*. Similarly, sections 35*a* and 35*b* of closure flaps 28*a* and 28*b* are disposed below and attached to the undersides of closure flaps 30*a* and 30*b*. Attachment may be by gluing, stapling or another conventional mechanism. As a result, panels 12 and 18 are now folded inwardly and upwardly. Then, the underside of end flap 20 is attached to the top side of flap 18 adjacent to fold line 22 between panel 18 and panel 42 in order to form a collapsed folded receptacle 11, as best shown in FIG. 2.

Receptacle 11 in FIG. 2 is in a collapsed condition, as previously described, and is suitable for packaging, display and sale purposes. Receptacle 11 may be folded in half along fold line 22 for carrying in a shirt or pants pocket prior to use. Receptacle 11 may include printed matter thereon, including applicable trademarks and directions for use. Preferably, the printed matter is created by soybean based inks, which have a minimal effect on the ecosystem.

Figure 3:
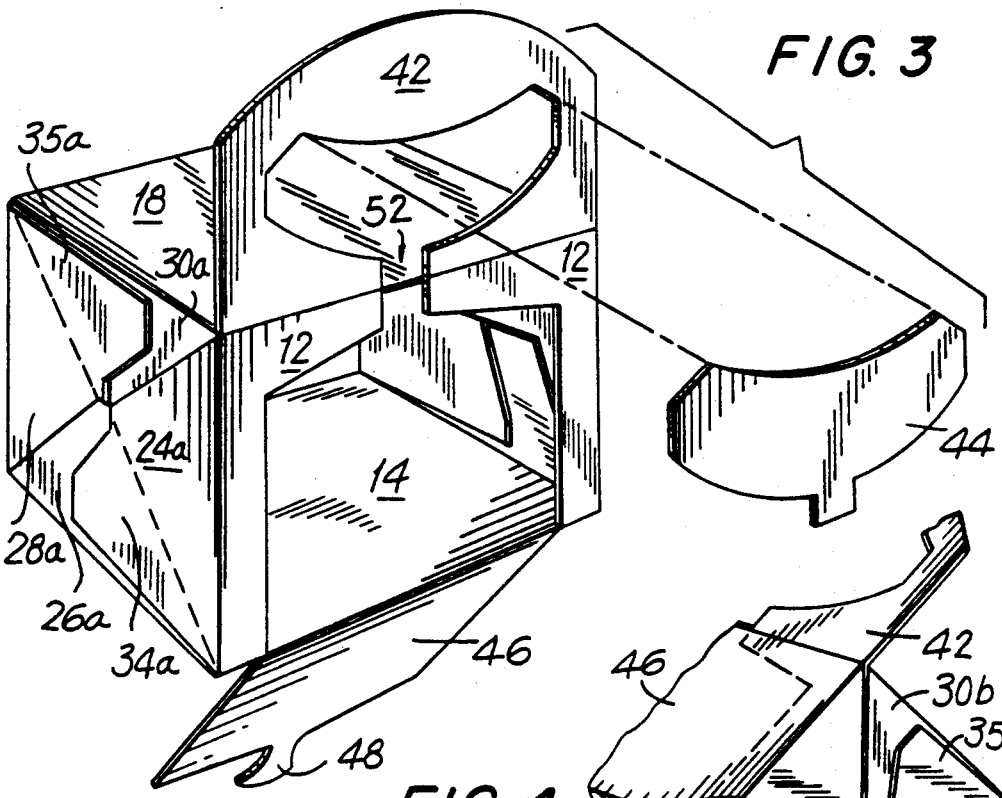
FIG. 3 is a perspective view of the animal waste disposal receptacle of the invention shown in an open or expanded condition and illustrating the removal of the scoop stick from the handle panel.
Figure 4:
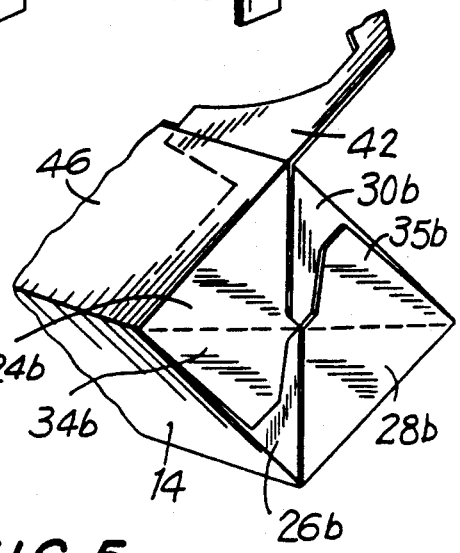
FIG. 4 is a partial perspective view of the end of the animal waste disposal receptacle shown in FIG. 3.

In order to erect receptacle 11 so that it is operable for the user, pressure is exerted by the user against the diagonally opposite corners thereof so that closure flaps 24*a*, 26*a*, 28*a* and 30*a*, and closure flaps 24*b*, 26*b*, 28*b* and 30*b* lock into position (see FIG. 3). As a result, receptacle 11 now has a generally rectangular box configuration, with handle panel 4 extending upwardly therefrom.

In operation of receptacle 11, the user must remove scoop stick cut-out 44 from handle panel 42. This is achieved by applying pressure on the scoop stick cut-out 44 to release cut-out 44 from panel 42, as shown in FIG. 3. Scoop stick 44 is now ready for pushing and/or scooping animal feces and excrement. Handle panel 42 now includes a handle opening and may be grabbed by the user for carrying receptacle 11.

To operate animal waste disposal receptacle 11, it is also necessary to form an opening therein. This is achieved by first pushing in, and then pulling out closure element 46 so that a window is formed in receptacle 11 (see FIG. 3). Closure element 46 is fully extended below receptacle 11, yet is maintained attached thereto along fold line 22. After closure element 46 has been fully extended, receptacle 11 is now ready for use. Using scoop stick 44, the user may pick up the animal excrement and place it into receptacle 11 through the Window formed therein. Alternatively, receptacle 11 is placed on the ground and scoop stick 44 is used to push the animal excrement into receptacle 11.

Figure 5:
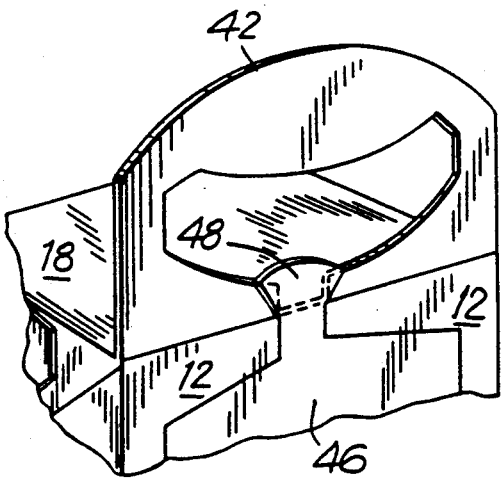
FIG. 5 is a partial perspective view of the animal waste disposal receptacle of the invention showing the closure element in a closed condition.
Figure 6:
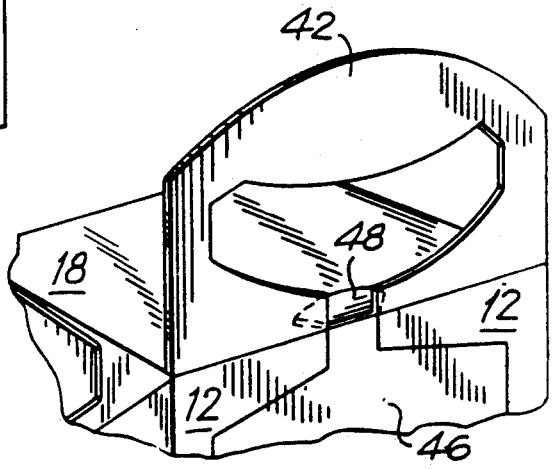
FIG. 6 is a partial perspective view similar to that in FIG. 5, but showing the closure element in a closed condition, with the locking tab thereof in a locked position.

Once the inside of receptacle 11 has been filled with the animal excrement, scoop stick 44 is inserted therein. Then closure element 46 is pivoted back over the window of receptacle 11 and locking tab 48 is pulled through slot 52 (see FIGS. 5 and 6) in order to securely lock receptacle 11 for subsequent disposal. As a result, the sanitary disposal of animal feces and excrement is maintained.

It will thus be seen that the objects set forth above, among those made apparent from the preceding description, are efficiently attained and, since certain changes may be made in carrying out the above method and in the articles set forth without departing from the spirit and scope of the invention, it is intended that all matter contained in this description is shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A receptacle for the disposal of animal waste comprising:

a container having a selectively sealable opening for enabling selective access to the interior of said container; and means for carrying said container, said carrying means having a disconnectable scoop for gathering up animal wastes and placing said wastes through said opening in the container, wherein disconnection of said scoop form said carrying means forms an opening in said carrying means for defining a handle extending from said container.

2.. The receptacle of claim 1, wherein said container is collapsible.

3. The receptacle of claim 1, wherein said container comprises a series of connected panels.

4. The receptacle of claim 3, wherein said container includes a closure element for selectively sealing said opening.

5. The receptacle of claim 4, wherein said closure element comprises a cut-out in one of said panels.

6. The receptacle of claim 5, wherein said closure element is pivotally swingable with respect to said one of said panels for selectively sealing said opening.

7. The receptacle of claim 5, wherein said opening is defined by said cut-out.

8. The receptacle of claim 1, wherein said carrying means comprises a carrying panel attached to said container.

9. The receptacle of claim 8, wherein said disconnectable scoop comprises a detachable cut-out in said carrying panel.

10. The receptacle of claim 6, wherein said closure element includes a locking tab for maintaining said closure element in a sealed position with respect to said opening.

11. The receptacle of claim 10, wherein the locking tab is receivable in a slot of said carrying means opening for sealing the closure element.

12. A cardboard blank for constructing an animal waste disposal receptacle comprising:

a series of container panels foldably connected to each other along common fold lines, said container panels defining the walls of the container when said blank is assembled, said series of container panels having a firs end panel and a second end panel;

a handle panel foldably connected to said first end panel along a common fold line, said handle panel having a detachable substantially central first portion adapted for use as a scoop and a remaining surrounding portion adapted for use as a handle for said container when said central first portion is detached;

wherein said second end panel includes an at least partially detachable door portion operable as a closure element to enable selective access to the inside of said container when said container is assembled.

* * * * *